US011162359B2

(12) United States Patent
Lawie

(10) Patent No.: US 11,162,359 B2
(45) Date of Patent: Nov. 2, 2021

(54) METHOD AND SYSTEM FOR ACQUIRING GEOLOGICAL DATA FROM A BORE HOLE

(71) Applicant: Reflex Instruments Asia Pacific Pty Ltd, Balcatta (AU)

(72) Inventor: David Lawie, Balcatta (AU)

( * ) Notice: Subject to any disclaimer, the term of this patent is extended or adjusted under 35 U.S.C. 154(b) by 0 days.

(21) Appl. No.: 16/627,288

(22) PCT Filed: Jun. 27, 2018

(86) PCT No.: PCT/AU2018/050654
§ 371 (c)(1),
(2) Date: Dec. 28, 2019

(87) PCT Pub. No.: WO2019/000037
PCT Pub. Date: Jan. 3, 2019

(65) Prior Publication Data

US 2020/0224532 A1 Jul. 16, 2020

(30) Foreign Application Priority Data

Jun. 27, 2017 (AU) ..... 2017902485

(51) Int. Cl.

| | |
|---|---|
| ***E21B 49/04*** | (2006.01) |
| ***E21B 49/00*** | (2006.01) |
| ***E21B 44/00*** | (2006.01) |
| *E21B 47/003* | (2012.01) |
| *E21B 47/06* | (2012.01) |
| *E21B 47/08* | (2012.01) |
| *E21B 47/12* | (2012.01) |

(52) U.S. Cl.
CPC ..... *E21B 49/04* (2013.01); *E21B 44/00* (2013.01); *E21B 49/003* (2013.01); *E21B 47/003* (2020.05); *E21B 47/06* (2013.01); *E21B 47/08* (2013.01); *E21B 47/12* (2013.01); *E21B 49/005* (2013.01)

(58) Field of Classification Search
CPC ..... E21B 49/04; E21B 49/003; E21B 49/005; E21B 49/00; E21B 44/00; E21B 47/003; E21B 47/06; E21B 47/08; E21B 47/12
See application file for complete search history.

(56) References Cited

U.S. PATENT DOCUMENTS 4,282,523 A * 8/1981 Youmans ..... E21B 19/22 340/854.1
2014/0144342 A1* 5/2014 Bye ..... E21C 41/30 102/311

* cited by examiner

*Primary Examiner* — Nicole Coy
*Assistant Examiner* — Yanick A Akaragwe
(74) *Attorney, Agent, or Firm* — Felix L. Fischer

(57) ABSTRACT

A method of obtaining geological data pertaining to a bore hole that comprises supporting a ground drill and a separate geological instrument (30) on a vehicle (52), the instrument (30) being capable of acquiring geological data including one or more of geophysical data, petro physical data, mineralogical and compositional data and hole geometry data from within the bore hole; drilling a bore hole using a ground drill, the bore hole having an exposed circumferential wall; moving the ground drill out of the bore hole and subsequently out of alignment with the bore hole; lowering and subsequently retrieving the instrument (30) from the bore hole; and, operating the instrument (30) while in the bore hole to acquire geological data of the ground in which the bore hole is drilled.

17 Claims, 3 Drawing Sheets

METHOD AND SYSTEM FOR ACQUIRING GEOLOGICAL DATA FROM A BORE HOLE

REFERENCES TO RELATED APPLICATIONS

This application is a national stage filing under 35 U.S.C. 371 and claims priority of International Application serial no. PCT/AU2018/050654 having an international filing date of 27 Jun. 2018 which in turn claims priority of Australian patent application serial no. 2017902485 filed on 27 Jun. 2017, the disclosures of which are incorporated herein by reference.

TECHNICAL FIELD

A method and system are disclosed for obtaining geological data from a bore hole. The data may then be used for various applications including but not limited to designing an optimal charge profile for the hole or material characterisation for improving downstream processing. The method and system contemplates providing a geophysical measurement instrument on a vehicle having an additional function such as a drill rig or an explosives truck.

BACKGROUND ART

To maximise efficiency of drill and blast in mining including downstream processing it is desirable to acquire geological and physical property data relating to the strata in which the blast holes are drilled. For example information relating to the compressive strength of the strata and the location of geological boundaries and discontinuities enables mine owners to custom-designed a charge profile for the hole to achieve optimal blasting outcomes. The outcomes could be for example a targeted particle size distribution or minimisation of fly rock, dust or heave.

Some of this data can be acquired while drilling a blast hole. Many drill rigs include measurement systems to provide information such as weight on bit and rate of penetration. This information can be used to estimate physical characteristics of the strata which in turn may be used to determine the type, volume and placement of explosive material(s) to achieve a desired outcome. However these data typically do not provide a sufficient level of diagnostic information alone to fully determine the geological nature of the drilled material.

In addition to or as an alternative it is also known to assay the material from the blast hole to obtain further information which cannot be acquired solely by drill rig performance. For example Australian patent application number 2012258434 by Lewis Australia Pty Ltd proposes a self-contained mobile sampling and processing facility for sampling and subsequently processing cuttings from the blast hole. This necessarily requires the use of a machine in addition to the regular pit vehicles of a drill rig and an explosives truck. Accordingly there is additional capital outlay for the machine itself and for the operator. Further the sampling and processing performed by the machine substantially slows down the drill and blast method.

Irrespective of how the information from the analysis of drill cuttings or other ground samples is acquired it can be used for different purposes including optimal design of the blast hole charge or determining the location in a blasted bench of material of different composition or particle size distribution. The latter information can be used for example by a metallurgist to improve the efficiency of material classification/separation at the mucking stage and other downstream physical and/or chemical processing stages.

Throughout this specification and claims, except where the context requires otherwise due to express language or necessary implication, the term "geological data" is intended to include geophysical data, petro physical data, mineralogical and compositional data and also hole geometry data. Here the expression "hole geometry data" is intended to include one of more of hole depth, volume, attitude and presence and/or configuration of fractures or voids.

The above references to the background art do not constitute an admission that the art forms a part of the common general knowledge of a person of ordinary skill in the art.

The above references are also not intended to limit the application of the method and system as disclosed herein.

SUMMARY OF THE DISCLOSURE

In a first aspect there is disclosed a method of obtaining geological data pertaining to a bore hole comprising:

supporting a ground drill and a separate geological instrument on a common vehicle, the instrument being capable of acquiring geological data including one or more of geophysical, petro physical, mineralogical and compositional data, and hole geometry data from within the blast hole;

drilling a bore hole using a ground drill the bore hole having an exposed circumferential wall;

moving the ground drill out of the bore hole and subsequently out of alignment with the bore hole;

lowering and subsequently retrieving the instrument from the bore hole;

operating the instrument while in the bore hole to acquire geological data of the ground in which the bore hole is drilled.

In one embodiment the borehole is a blast hole.

In a second aspect there is disclosed a method of drilling and blasting a hole comprising: drilling a blast hole and obtaining geological data relating to the blast hole using the method of the first aspect; and designing a charge profile of explosive material for the blast hole using the geological data.

In one embodiment the second aspect further comprises controlling an explosive materials supply vehicle to deposit explosive materials in the blast hole in accordance with the charge profile.

In a third aspect there is disclosed a method of charging a blast hole with explosive material comprising:

driving a vehicle carrying one or more explosive materials to a blast hole having a hole wall;

aligning a geological measurement instrument supported on the vehicle with the blast hole and lowering and subsequently retrieving the instrument from the blast hole;

operating the instrument while in the blast hole to acquire geological data of the ground in which the blast hole exists;

using the acquired geological data to determine geological characteristics of the ground surrounding the blast hole; and depositing into the blast hole one or more explosive materials from the vehicle on the basis of the determined geological characteristics.

In a fourth aspect there is disclosed a bore hole drilling and data collection system comprising:

a vehicle;

a drill string mounted on the vehicle and capable of drilling a bore hole;

a geophysical measurement instrument capable of acquiring geophysical data relating to the a bore hole drilled by the drill string; and a handling system mounted on the vehicle and associated with the drill string and the geophysical measurement instrument, the handling system being arranged to: move the drill string into and out of a bore hole, align the instrument with the bore hole and subsequently move the instrument into and out of the bore hole.

In a fifth aspect there is disclosed a blast hole charging system capable of charging a blast hole with explosive material the system comprising:

a vehicle carrying a supply of explosive material and a geophysical measurement instrument capable of acquiring geophysical data relating to the a blast hole drilled by the drill string;

a handling system mounted on the vehicle and associated with the geophysical measurement instrument, the handling system being arranged to move the instrument into and out of the blast hole;

a control system for controlling discharge of explosive material from the vehicle into the blast hole on the basis of the acquired geophysical data.

BRIEF DESCRIPTION OF THE DRAWINGS

Notwithstanding any other forms which may fall within the scope of the system and method as set forth in the Summary, specific embodiments will now be described, by way of example only, with reference to becoming drawings in which.

DETAILED DESCRIPTION OF SPECIFIC EMBODIMENTS

Background Technology

Figure 1:
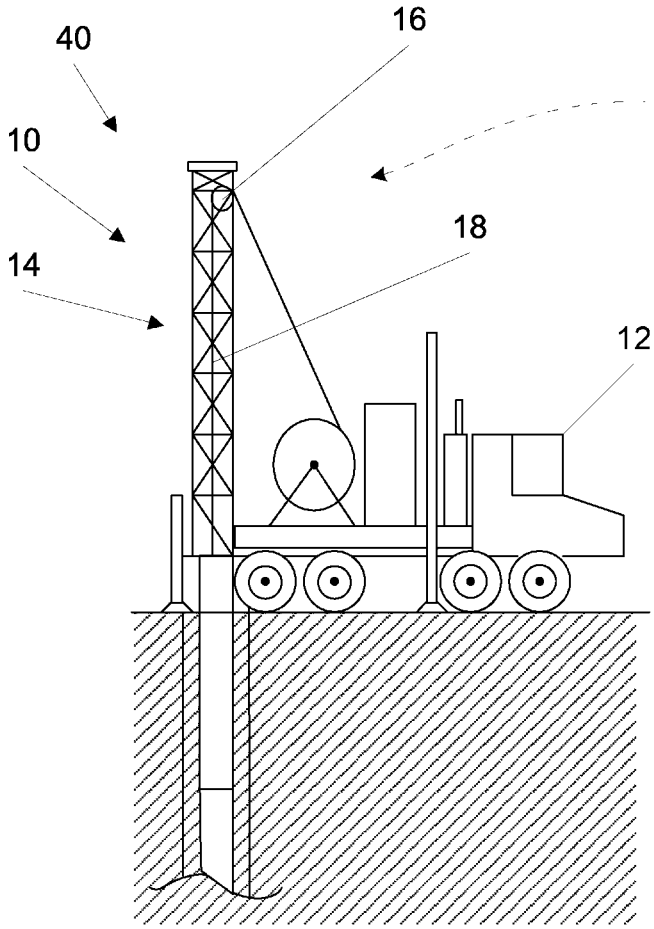
FIG. 1 is an illustration of a drill rig which may be incorporated in a first embodiment of the disclosed method and system for acquiring geological data from a bore hole and in a specific application pertaining to charging a blast hole.

FIG. 1 is an illustration of one type of drill rig 10 used for drilling blast holes. The drill rig 10 has a track mounted body 12 which includes an operator cab and a drill tower 14. The drill tower can be tilted through 90° between a horizontal position and a vertical position as shown in FIG. 1. A rotation head 16 is mounted on the tower for providing torque to a drill string 18. One or more hydraulic rams (not shown) are provided on the tower 14 for providing pull down or pull back to the drill string 18 via the rotation head 16. However as will become apparent from the following description embodiments of the disclosed method and system can be used in relation to other forms of blast hole drill rigs.

It is common for a drill rig 10 to be provided with a GPS to enable accurate positioning for drilling blast holes on a bench or survey data in underground applications. Indeed autonomous drill rigs are currently available which can be programmed with the location of blast holes. These rigs are able to self-drive and position their masts at the programed locations to automatically drill the blast holes. It is also common for drill rigs to measure and record or transmit various performance indicators during drilling. These indicators include for example weight on bit and rate of penetration.

Figure 2:
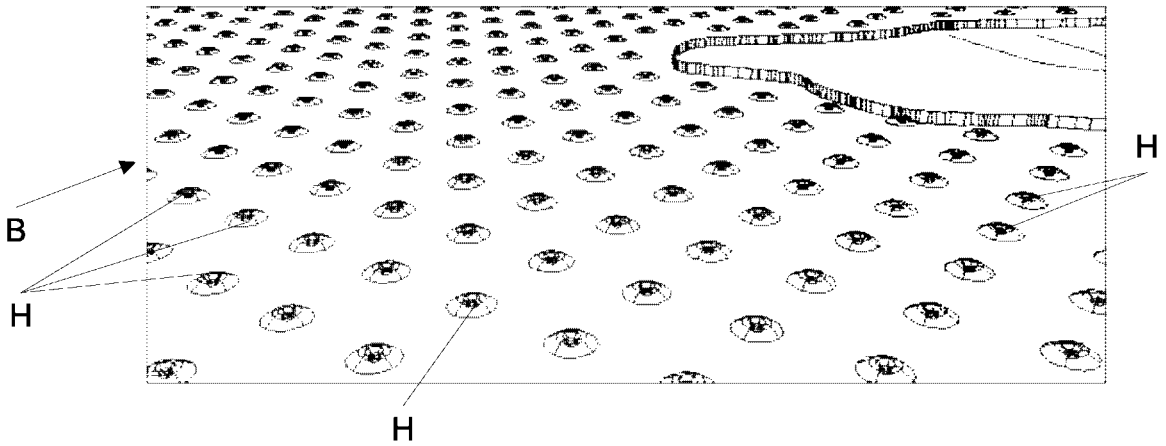
FIG. 2 is a representation of a bench in which a plurality of blast holes have been drilled using a drill rig (or rigs) of the type shown in FIG. 1.

FIG. 2 illustrates a bench B in which a plurality of blast holes H have been drilled using a drill rig 10. Each hole is surrounded by a cone made from drill cuttings. In order to optimise production from the bench it is advantageous to acquire geological and other data relating to the strata in, and surrounding, the blast hole. This enables for example different grades and/or types of material to be identified as well their boundaries. This information can then be used to determine the explosives profile for the holes and the bench to optimise fragmentation and/or mucking. This is beneficial for downstream processing.

Once the blast holes have been drilled an explosives truck is driven onto the bench or stope area. An operator will then analyse data relating to the strata derived from the geological data available to the operator to determine an appropriate charge to achieve a desired effect and charge the holes accordingly.

The drill rig and the explosives truck are different types of "mine vehicles" that are allowed onto a bench or underground. For safety reasons mine owners very tightly control the number of vehicles and personnel on a bench or underground. Some prior art drill rigs include add-on sampling systems enabling them to acquire a sample of the drill cuttings for subsequent as saying. However when this is not the case a third vehicle, such as that described in AU 2012258434 mentioned in the Background Art discussion above, may be allowed onto the bench to enable the acquisition of cutting samples for analysis.

General Discussion of Disclosed Method and System

Embodiments of the disclosed method and system have been developed to facilitate the acquisition of geological data pertaining to the ground in which bore holes are drilled without the need for assaying of drill cuttings or introducing any additional vehicles or personnel onto a bench, drive or drilling and/or blasting zone over and above that required for performing another required function.

In two examples, which are discussed in greater detail below in the context of the borehole being blast holes, embodiments of the disclosed method and system involve mounting a geological instrument on a pit vehicle such as a drill rig or explosives truck to enable acquisition of geological data (as defined above) of the ground in which the bore/blast hole is drilled.

When the instrument is used in conjunction with a drill rig the geological data derived from the instrument can be made available, in either a raw or a processed state, to an explosives vehicle or an intermediate analytics platform or processor. The geological data may be accompanied by various data acquired by the drill rig itself (often referred to as Measure While Drilling (MWD) data). The geological data with or without being supplemented by the MWD data may then be used to determine an appropriate charge profile. This in turn can be used by an operator of an explosives truck to charge the hole; or used by the explosives truck to autonomously control discharge of explosive materials to achieve the charge profile.

Alternately the instrument may be mounted on the explosive struck itself and subsequently lower into and retracted from the blast hole to acquire the data by an instrument handling system on the explosives truck. Drill rig data can optionally be transmitted or otherwise made available to the explosive struck to be used in conjunction with the data from the instrument to again control the discharge of exposes material from the truck into the hole.

The geological data may have other applications including for mine processing optimisation. For example this can assist in determining appropriate processing parameters for extracting a target mineral.

Geological Instrument Incorporated in Embodiments of the Method and System

Figure 3:
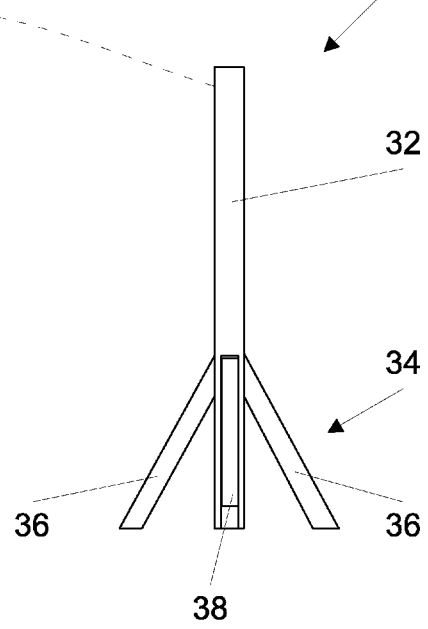
FIG. 3 is a schematic representation of a geological data measuring instrument may be incorporated in various embodiments of the disclosed method and system for acquiring blast hole geological data and charging a blast hole.

FIG. 3 is a representation of one possible form of geological instrument 30 that can be incorporated in embodiments of the disclosed method and system. These embodiments are described in the context of the boreholes being blast holes. The instrument 30 comprises a tubular body 32. The body 32 may conveniently have the same physical dimensions as the drill string 18 used for drilling the blast holes. Indeed the body 32 may be considered to comprise in substance a drill string 18 without a drill bit. Housed within the instrument 30 is a plurality of measurement sensors and devices for acquiring a range of geological data (i.e. geophysical, petro-physical, mineralogical or compositional data and hole geometry data) pertaining to the strata in the ground in which the blast holes are drilled. The data includes but is not limited to any one, or a combination of any two or more of the following:

(a) gamma radiation emitted by material in the hole
(b) density of material in the hole
(c) reflectivity of electromagnetic radiation
(d) reflectivity of acoustic or ultrasonic waves
(e) magnetic susceptibility of material in the hole
(f) electrical resistivity/conductivity/impedance of material in the hole
(g) magnetic vector field
(h) hole dip
(i) Hole wall temperature
(j) Sonic velocity
(k) Contact hardness
(l) hole azimuth
(m) hole diameter
(n) hole profile
(o) hole volume.
(p) water level The instrument 30 includes a hole contact mechanism 34 which is arranged to physically contact the inner circumferential wall of the blast hole at two or more locations spaced about a longitudinal axis of the hole. Ideally these locations are equally spaced around the longitudinal axis. For example when the hole contact mechanism 34 contacts a blast hole at two locations ideally these locations are diametrically opposed.

The hole contact mechanism comprises a plurality of arms 36 biased from the instrument body 32 into contact with the blast hole wall. When initially lowering the instrument 30 into the blast hole the arms 36 are held in a retracted position parallel to the length of the body 32. Once the instrument 30 reaches a bottom of the blast hole the arms 36 are released enabling the applied bias to push them into contact with the wall of the blast hole. The arms 36 may be released by way of a mechanical latch operated by contact of the instrument 30 with the bottom of the hole. Alternately a latch may be released electronically. In any event the manner of releasing the arms 36 is not critical to the overall functioning of the instrument 30 and more specifically the disclosed system and method.

The hole contact mechanism 34 enables measurements of the hole diameter at different depths as well as more generally hole profile measurements. By also measuring or otherwise acquiring hole depth either through use of the instrument 30, or as part of MWD data the volume of the hole can also be determined. The profile measurements may for example detect the presence and location of a fissure or void. This is useful information as it foreshadows a potential pressure leakage path for the explosives material. Armed with this information a blasting technician may attempt a seal the fissure prior to charging the hole, or vary the charge profile to take account of the potential pressure leakage path.

The hole contact mechanism 34/arms 36 may also be arranged to facilitate the measurement of hardness of the material forming the wall of the blast hole. This can be achieved for example by mounting scratching devices on the arms 36 which are in turn coupled with strain or pressure gauges. Thus when the instrument 30 is retracted from the blast hole with the arms 36 biased into contact with the blast hole wall, measurements relating to the hardness of the material the hole wall can be acquired.

The present embodiment of the hole contact mechanism 34 which includes the biased arms 36 can only be used while the instrument 30 is being retrieved from a blast hole. However other forms of the hole contact mechanism 34 could be used during either one or both of lowering and retrieving the instrument 30. An example of this would be where each arm 36 is replaced with two arms, one arm being pivotally connected to the body 32 at one end, pivotally connected at an opposite end to the second arm with the opposite end of the second arm being slidably coupled to the body 32.

The instrument 30 may also include one or more windows 38 made from non-metallic materials such as glass or plastics. The windows 38 can be located to align with specific sensors or detectors which require material transparency for operations such as magnetic susceptibility sensors.

The instrument 30 may also include a data transmission system to enable acquired data to be transmitted to a data receiver located remote for the instrument 30. The data receiver may include a data storage system and/or a data processing system. Alternately or additionally the instrument 30 may have on-board data storage or processing capability. The data transmission system can be arranged to stream data in real time to the data receiver or alternately transmit the data in raw or processed form which is stored on board of instrument 30 after the instrument 30 has been retrieved from a blast hole.

Power for operating the instrument 30 may be provided in several different ways. These include a direct hardwired connection to a battery or generator of the drill rig 10; batteries within the instrument 30 itself; or by a power generator within the instrument 30. The power generator within instrument 30 can include for example an electric generator which is provided with torque via the rotation head 16. The electric generator if provided may be arranged to charge a rechargeable battery within instrument 30 which in turn provides electrical power for all of the senses devices and equipment which are in or otherwise constitute the instrument 30.

Blast Hole Drilling and Data Collection System 40

One embodiment of the disclosed system is a blast hole drilling and data collection system 40. This system 40 comprises a vehicle in the form of the drill rig 10 which carries both a drill string 18 capable of drilling a bore hole (which in this embodiment is a blast hole) and the instrument 30. Conveniently the instrument 30 is held on a rack on the drill tower 14. With reference to the Figures this may be considered as the combination of features shown in FIGS. 1 and 3, where the instrument 30 is mounted on the tower 14 in addition to the drill string 18.

A handling system is also provided on the vehicle and associated with the drill string 18 and the geophysical instrument. The handling system is arranged to: move the drill string 18 into and out of a blast hole and subsequently move the instrument into and out of the blast hole. The handling system can be constituted by a combination of the rams which provide the pull down or pull back to the drill string 18; and a rod changer which disconnects the drill string from the rotation head 16 and subsequently connects the instrument 30 to the rotation head 16. This is done without moving the drill rig 10 or the tower 14. Therefore the instrument 30 is automatically aligned with the blast hole that was previously produced by the drill string 18.

While the instrument 30 is attached to the rotation head there is no need or necessity for the rotation head to be powered to cause rotation of the instrument 30. However the option remains available to activate the rotation head while the instrument 30 is being lowered into and/or from the retrieved blast hole.

An ordinary drill rig 10 can be converted into an embodiment of the disclosed blast hole drilling and borehole data collection system by mounting of instrument 30 onto the drill rig 10. The instrument 30 can be operated to acquire data either while being lowered into the blast hole, while being retracted from the blast hole or both.

Optionally the blast hole drilling and data collection system 40 can include a data processing system capable of processing the acquired geological data to map strata boundaries over a region in which the blast hole is drilled. This data processing system may be remote from the instrument 30 itself. In particular this data processing system may be cloud-based, located in a remote control centre, or located on board an explosives truck or the rig itself. When the data processing system is remote from the instrument 30, the transmission system of instrument 30 transmits the acquired geological data to the data processing system.

The blast hole drilling and data collection system 40 can be further arranged to provide drill rig data which can be subsequently correlated with the geological data and used by the data processing system in analysing the ground structure and composition and subsequently mapping the strata boundaries. The drill rig data can be transmitted by the drill rig 10 independently of the instrument 30. Alternately the drill rig data can be fed to the instrument 30 and correlated in real time with the geological data. In that event the combination of the drill rig data and the geological data can be transmitted or otherwise provided to the data processor or analytic platform.

Figure 4:
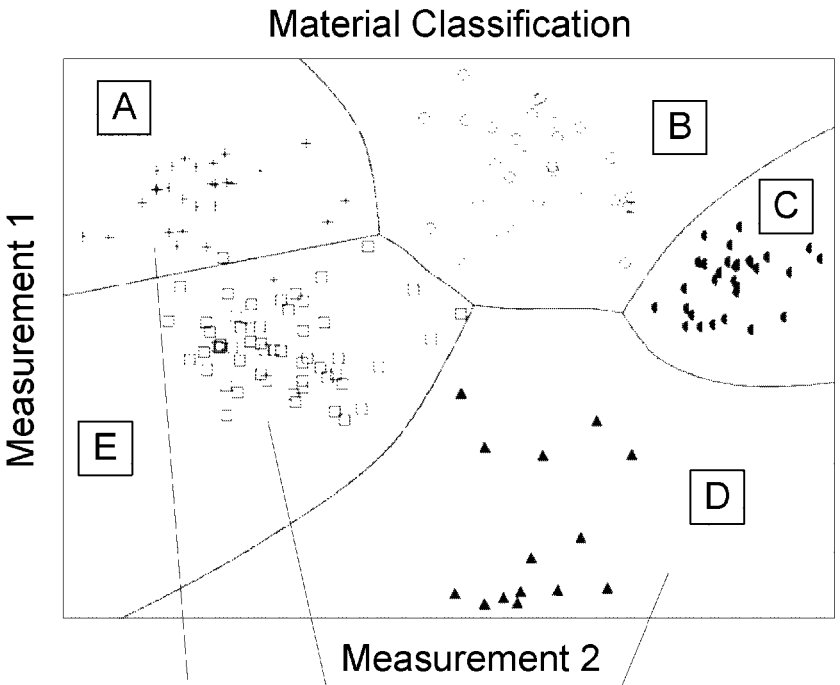
FIG. 4 illustrates one way of representing geological data acquired by use of the disclosed method and system which may subsequently determine the type of strata automatically to aid in the design of a charge profile for a blast hole.
Figure 5:
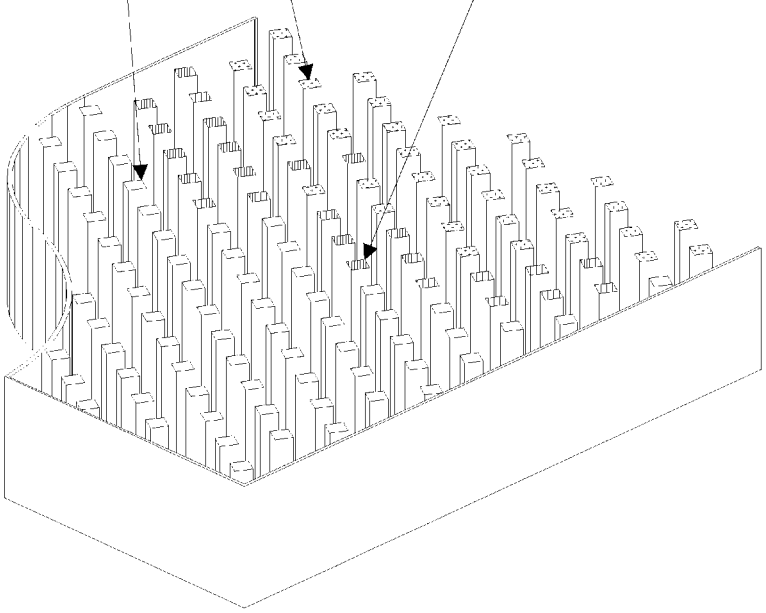
FIG. 5 illustrates a three-dimensional model of the strata generated using the acquired geological data and which may also be used to design a charge profile for a blast hole.

FIGS. 4 and 5 depict different forms of maps that may be generated using the geological data by itself or in conjunction with the drill rig data. FIGS. 4 and 5 is a 2D overlay map of material property types showing boundaries between regions A, B, C and D which have strata of different characteristics which may require different charging profiles for blast holes of the same depth and configuration. FIG. 5 is a three-dimensional map of part of a bench in which regions containing strata of different characteristics are highlighted in different colours. The blast hole drilling and data collection system 40 can be arranged to acquire the geological data and/or the drill rig data at regular depth intervals over the entire depth of the blast hole. For example the data can be acquired at, but not limited to, depth intervals of 1 cm, 5 cm, 10 cm, or 20 cm. This can be achieved by continuously acquiring the data but storing or transmitting the data at successive prescribed depth intervals.

Finally the data processing system, having acquired the geological data by itself or in conjunction with the drill rig data can be programmed or otherwise arranged to determine a charge profile for explosive material to be deposited in to the blast hole. The charge profile can be provided to an explosives truck to either enable an operator of the truck to charge respective boreholes in accordance with their charge profile; or to facilitate autonomous operation of the explosives truck for charging the boreholes.

Blast Hole Charging System 50

Figure 6:
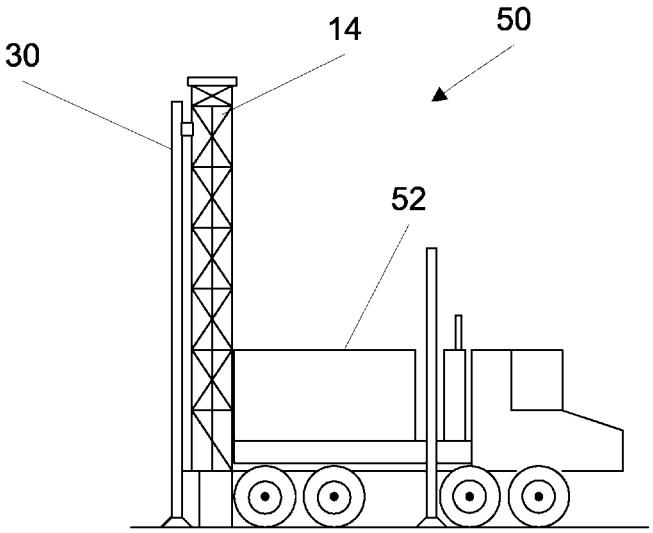
FIG. 6 is a representation of an explosives truck which may be incorporated in a second embodiment of the disclosed method and system for acquiring blast hole geological data and charging a blast hole.

A further embodiment of the disclosed system is in the form of a blast hole charging system 50 shown in FIG. 6. The system 50 is capable of charging a blast hole with explosive material and in broad terms comprises a combination of geological instrument 30 described above, a vehicle 52 carrying a supply of explosive (i.e. an explosives truck), a handling system mounted on the vehicle and associated with the instrument 30 for moving the instrument 30 into and out of the blast hole. The handling system mounted on the vehicle 52 for lowering instrument 30 into the blast hole and subsequently retracting instrument 30 from the blast hole. The handling system may take many different forms including for example a tower 14 with a winch or ram, or a boom with a pulley and cable winch system.

The instrument 30 operates in exactly the same manner as described above in relation to the blast hole drilling and data collection system 40 in terms of acquiring geological data relating to the blast hole. Such data is acquired when instrument 30 is lowered into or removed from the blast hole, or both.

However in this embodiment no drill rig data is generated by the explosives carrying vehicle 52. Such drill rig data may nonetheless be available to the blast hole charging system 50. For example the drill rig data may have been transmitted by a drill rig 10 to a remote data receiver. The explosives vehicle may be arranged to electronically source the drill rig data from the data receiver and subsequently correlate that data with the geological data acquired by the instrument 30.

A data processing system processes the geological data, and if available or if used, the drill rig data, to design an optimised charging profile for each blast hole. The charging profile can be used either by an operator of the explosives truck to charge the hole, or by a control system of the explosives truck to facilitate the autonomous charging of the boreholes. More particularly the data processing system is arranged to design a charge profile for the blast hole and provide signals to the control system to facilitate the discharge of explosive material to accord with the charge profile.

The explosives vehicle in the blast hole charging system may carry a plurality of explosives which differ in terms of their explosive power. In this way different blast holes can be charged with different explosives depending on the characteristics of the strata surrounding the blast holes, or alternately a blast hole may be charged with two or more different explosives at different depths to accord with for example strata boundaries.

Thus in summary the instrument 30 can be carried by either a drill rig 10 or by an explosives carrying vehicle 52. The geological data acquired by the instrument 30 is the same in both instances. The geological data can then be used either by itself or in conjunction with drill rig data to design a charging profile for each of the blast holes. This data is specific to each blast hole. The blast holes can be readily identified by their GPS position. The GPS position may be acquired by the drill rig at the time of drilling the blast holes with or without the instrument 30. However the instrument 30 can also be provided with its own GPS. Thus when instrument 30 is incorporated in the blast hole drilling and data collection system 40, the instrument 30 rather than the drill rig can acquire GPS data for each of the blast holes. In the event the blast hole charging system 50, the GPS in the instrument 30 can be used to identify individual blast hole is being charged; or alternately a GPS system on the explosives truck can identify specific blast holes. The charging profile is used by an operator of the explosives truck either directly or via a control system on the explosives truck to load the blast holes with explosive material according to their specific charge profile.

In the blast hole charging system 50 and on-board or remote processor can process the geological data acquired by the instrument 30 in near real-time and provide information to the blasting technician to either enable the determination of a charge profile or to automatically determine a charge profile. This may be achieved in the time taken to withdraw the instrument 30 from the hole and park it in an appropriate position on the truck. In this way there is minimal impact on the workflow of the blasting technician. Also as previously mentioned the system 50 may be arranged so that the charge hole profile autonomously charges the hole with explosive material in accordance with the charge profile.

Whilst a number of specific method and system embodiments have been described, it should be appreciated that method and system maybe embodied in many other forms. For example in relation to the description of the blast hole drilling and data collection system 40 which utilises the same drill rig is used for drilling the blast hole a mechanism or system for handling the instrument 30 can take many different forms. In a drill rig which does not have a carousel type system for changing the drill string and additional handling system can be fitted to the drill rig to enable the instrument 30 to be lowered into and removed from the blast hole after the blast hole has been drilled. Alternately in a rig which has an automated bit changing system the instrument 30 may be installed in a dummy bit housing and screwed onto existing drill pipe so that the bit and the instrument 30 can be interchanged.

Figure 7:
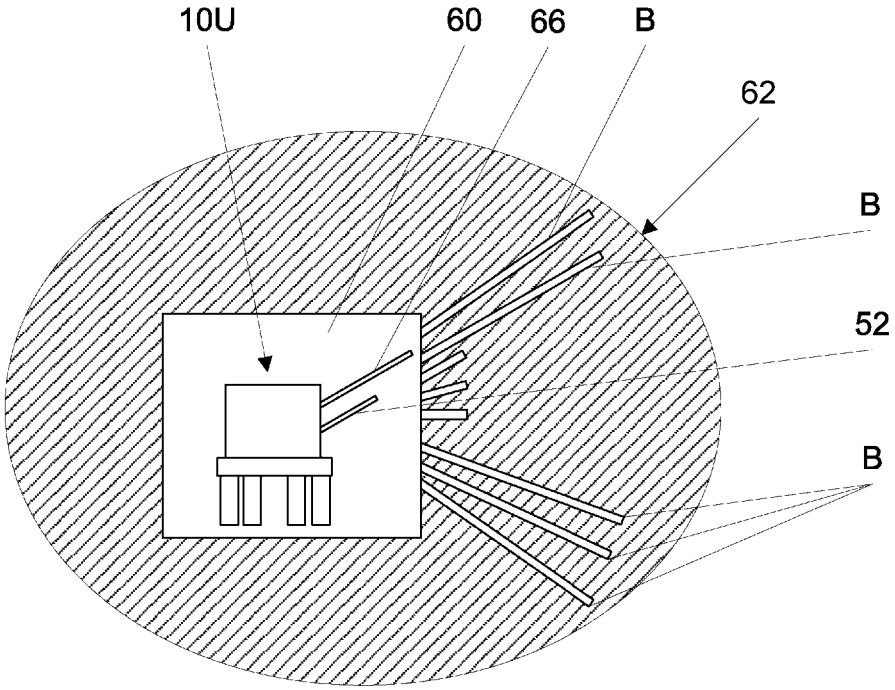
FIG. 7 is an illustration of an embodiment of the disclosed method and system for acquiring geological data from a bore hole in an underground mining application.

Further, the above embodiments are described in the context of blast holes and more particularly blast holes formed in an open cut or aboveground site. However embodiments of the disclosed method and system are not limited to blast holes nor to open cut or aboveground applications. For example embodiments of the system may be mounted on drill rigs/machines in underground mining for example to develop a drive or stope. An example of this is illustrated in FIG. 7 which shows a rig 10*u* drilling holes in a stope 60 of an underground mine 62. The rig 10*u* is in a different form and configuration to the rig 10 used for the open cut mine shown in FIG. 1 but both rigs have the same purpose and functionality namely to drill holes into the ground. For this purpose the rig 10*u* of FIG. 7 also has at least one arm 64 provided with a drill 66 connectable to a rotary drive. The arm 64 in effect replicates the function of the drill tower 14 for supporting the drill string/rod while being rotated as well as applying a penetration force to advance the drill into the ground (the equivalent of pull down applied by rams or winches on the tower 14). In the underground application the bore holes B may be inclined upward of the horizontal.

Further irrespective of whether the system is used for aboveground or underground rigs the rigs may be single pass or multi-pass rigs. In the case of a multi-pass rig the rig will include a carousel or other type of system to enable the coupling of additional drill rods. In this scenario instrument 30 can be provided in the carousel and in effect utilised as the initial rod of the drill string.

Additionally the geological data acquired is not limited to use for optimising the charge profile for a blast hole. The geological data may be used for other applications. This includes for example using the geological data to classify material in a bench so that after fragmentation and at the time of mucking the location of material of specific characteristics is known. In this way for example material of different grades or composition can be sorted at the time of mucking and sent to different processing streams. Alternately the downstream processing conditions may be varied in anticipation of specific material characteristics (for example carbonate content) to maximise target mineral extraction. In such applications the boreholes need not necessarily or primarily be blast holes. The boreholes may simply be exploration holes.

Additionally an instrument 30 may be used both on the blast hole drill rig 10 and a similarly instrument 30 used on the explosives truck 52. Accordingly two sets of geophysical data may be acquired for the same blast hole at different times. This enables auditing of the quality of the acquired geophysical data. The a substantive difference in the geophysical data required from the same blast hole may be indicative of for example of a hole collapse, the development of a fissure or void, or indeed a faulty instrument 30 at one of the drill rig 10 and the explosives truck 52. In the latter case further independent measurement can determine which instrument 30 provided the accurate information for use in determining the charge profile.

In the claims which follow, and in the preceding description, except where the context requires otherwise due to express language or necessary implication, the word "comprise" and variations such as "comprises" or "comprising" are used in any clue inclusive sense, i.e. to specify the presence of the stated features but not to preclude the presence or addition of further features in various embodiments of the method and system disclosed herein.

The invention claimed is:

1. A method of charging a blast hole with explosive material comprising:

aligning a geological measurement instrument, supported on a vehicle, with a bore hole, the bore hole having a bore hole wall;

lowering the instrument into the bore hole;

operating the instrument while in the bore hole to acquire geological data of the ground in which the bore hole exists;

acquiring the geological data, using the instrument, at a plurality of depths in the bore hole;

retrieving the instrument from the bore hole;

using the geological data, acquired by the instrument at a plurality of depths in the bore hole, to determine geological characteristics of the ground surrounding the bore hole;

using the geological data, acquired by the instrument at a plurality of depths in the bore hole, in combination with drill rig data to determine the charge profile of explosive materials for the blast hole, the drill rig data pertaining to the operation of a drill rig and acquired while drilling the bore hole using the drill rig;

correlating the drill rig data with the geological data, acquired by the instrument at a plurality of depths in the bore hole, and using a combination of the drill rig data and the geological data to control the depositing of the explosive materials into the blast hole;

determining a charge profile of explosive materials for a blast hole using the geological data acquired by the instrument at a plurality of depths in the bore hole; and depositing into the bore hole one or more explosive materials on the basis of the determined charge profile for the geological characteristics of the ground surrounding the blast hole.

2. The method according to claim 1, wherein acquiring the geological data, using the instrument, at a plurality of depths in the bore hole comprises continuously acquiring the geological data.

3. The method according to claim 2, further comprising storing or transmitting the acquired geological data at successive prescribed intervals.

4. The method according to claim 1, further comprising acquiring the geological data, using the instrument, at regular depth intervals in the bore hole.

5. The method according to claim 1, wherein depositing into the bore hole one or more explosive materials from the vehicle on the basis of the determined charge profile comprises depositing the one or more explosive materials at different depths.

6. The method according to claim 1, wherein depositing into the bore hole one or more explosive materials comprises depositing the one or more explosive materials, into the bore hole, from the vehicle on which the instrument is supported or from an explosives carrying vehicle.

7. The method according to claim 1, further comprising physically contacting the bore hole wall, using the instrument, at two or more locations spaced about a longitudinal axis of the bore hole while retrieving the instrument from the bore hole.

8. The method according to claim 7, wherein acquiring the geological data includes acquiring data providing a measure of diameter of the bore hole while the instrument is in physical contact with the bore hole wall at the two or more locations.

9. The method according to claim 7, wherein physically contacting the bore hole wall comprises biasing two or more arms from the instrument into contact with the bore hole wall.

10. The method according to claim 1, wherein acquiring the geological data includes acquiring data providing a measure of hardness of material in the bore hole wall.

11. The method according to claim 10, wherein the data providing a measure of hardness of material is acquired while the instrument is in physical contact with the bore hole wall.

12. The method according to claim 1, wherein acquiring the geological data comprises acquiring the data at a plurality of different depths while the instrument is being retrieved from the bore hole.

13. The method according to claim 1, wherein the geological data includes any one, or a combination of any two or more of the following data:

(a) gamma radiation emitted by material in the a hole comprising a bore hole intended as a blast hole
(b) density of material in the hole
(c) reflectivity of electromagnetic radiation
(d) reflectivity of acoustic or ultrasonic waves
(e) magnetic susceptibility of material in the hole
(f) electrical resistivity/conductivity/impedance of material in the hole
(g) magnetic vector field
(h) hole dip
(i) hole wall temperature
(j) sonic-wave velocity
(k) contact hardness
(l) hole azimuth
(m) hole diameter
(n) hole profile
(o) hole volume
(p) water depth.

14. The method according to claim 1, further comprising transmitting the geological data, acquired by the instrument at a plurality of depths in the bore hole, to a data receiver remote from the instrument.

15. The method according to claim 1, further comprising processing the geological data, acquired by the instrument at a plurality of depths in the bore hole, to map strata boundaries over a region in which the bore hole is drilled.

16. The method according to claim 1, wherein depositing into the blast hole one or more explosive materials comprises depositing at least two explosive materials of different explosive power.

17. The method according to claim 1, wherein the drill rig data includes one or both of weight on bit and rate of penetration.

* * * * *